US006784652B1

(12) United States Patent
Aude

(10) Patent No.: US 6,784,652 B1
(45) Date of Patent: Aug. 31, 2004

(54) STARTUP CIRCUIT FOR BANDGAP VOLTAGE REFERENCE GENERATOR

(75) Inventor: Arlo Aude, Atlanta, GA (US)

(73) Assignee: National Semiconductor Corporation, Santa Clara, CA (US)

( * ) Notice: Subject to any disclaimer, the term of this patent is extended or adjusted under 35 U.S.C. 154(b) by 0 days.

(21) Appl. No.: 10/374,555

(22) Filed: Feb. 25, 2003

(51) Int. Cl.[7] ..... G05F 3/16
(52) U.S. Cl. ..... 323/316; 323/315
(58) Field of Search ..... 323/313, 314, 323/315, 316, 317; 327/535, 538, 539, 543; 330/257, 288

(56) References Cited

U.S. PATENT DOCUMENTS 4,837,496 A * 6/1989 Erdi ..... 323/315
5,686,823 A * 11/1997 Rapp ..... 323/313
5,798,637 A * 8/1998 Kim et al. ..... 323/313
6,002,245 A * 12/1999 Sauer ..... 323/315
6,201,435 B1 * 3/2001 Chou ..... 327/543
6,232,828 B1 * 5/2001 Smith et al. ..... 327/539
6,528,980 B1 * 3/2003 Smith ..... 323/315

* cited by examiner

*Primary Examiner*—Matthew V. Nguyen
(74) *Attorney, Agent, or Firm*—Vedder, Price, Kaufman & Kammholz, P.C.

(57) ABSTRACT

A startup circuit for a bandgap voltage reference generator circuit. Monitoring an internal reference voltage of the bandgap voltage reference generator circuit, current flow for the bandgap circuit diodes is initiated following circuit startup, e.g., initial application or DC power. In one embodiment, the monitored bandgap circuit reference voltage is replicated and used to assert and then de-assert a control signal used for initiating the diode current flow.

15 Claims, 2 Drawing Sheets

STARTUP CIRCUIT FOR BANDGAP VOLTAGE REFERENCE GENERATOR

BACKGROUND OF THE INVENTION

1. Field of the Invention

The present invention relates to bandgap voltage reference generators, and in particular, to startup circuits used to ensure that the host bandgap voltage reference generator circuit enters and remains in a valid and stable operating state following the initial application of DC power.

2. Description of the Related Art

As is well known, bandgap voltage reference generator circuits are used to provide stable reference voltages over wide variations in operating temperatures. One problem associated with these types of circuits, however, involves circuit startup characteristics. For example, a fast rise time in the power supply voltage will generally result in reliable circuit startup. However, startup may not occur if the power supply voltage increases slowly and the operating temperature is low due to the fact that low current beta characteristics of the bipolar circuit elements (due to the low temperature) are often too low to provide the leakage currents needed to produce current regeneration necessary to initiate proper circuit operation. Furthermore, even if the circuit initially starts up properly, if the power supply voltage drops low enough to shut down the circuit, the circuit may not turn back on properly once the power supply voltage has been restored to its proper value. This problem of circuit startup due to slow or marginal power supply voltages has become even more significant with increasing uses of circuits operating at very low power supply voltages.

SUMMARY OF THE INVENTION

In accordance with the presently claimed invention, a startup circuit for a bandgap voltage reference generator circuit monitors an internal reference voltage of a bandgap voltage reference generator circuit and initiates current flow for the bandgap circuit diodes following circuit startup, e.g., initial application of DC power. In one embodiment, the monitored bandgap circuit reference voltage is replicated and used to assert and then de-assert a control signal used for initiating the diode current flow.

In accordance with one embodiment of the presently claimed invention, a startup circuit for a bandgap voltage reference generator circuit includes a reference terminal, a control terminal and voltage monitoring circuitry. The reference terminal conveys a reference voltage including first and second voltage magnitudes related to a current flow in a bandgap voltage reference generator circuit. The control terminal conveys a current control signal for initiating the current flow. The voltage monitoring circuitry, coupled to the reference and control terminals, provides the current control signal in response to reception of the reference voltage. The current control signal includes an asserted state corresponding to the first reference voltage magnitude and a de-asserted state corresponding to the second reference voltage magnitude, and the current flow initiation occurs in response to the asserted state.

In accordance with another embodiment of the presently claimed invention, a startup circuit for a bandgap voltage reference generator circuit includes voltage replication circuitry and signal driving circuitry. The voltage replication circuitry provides a replica voltage responsive and corresponding to reception of a reference voltage including first and second reference voltage magnitudes related to a current flow in a bandgap voltage reference generator circuit. The signal driving circuitry, coupled to the voltage replication circuitry, provides a current control signal in response to reception of the replica voltage. The current control signal includes an asserted state corresponding to the first reference voltage magnitude and a de-asserted state corresponding to the second reference voltage magnitude, and the current flow initiation occurs in response to the asserted state.

DETAILED DESCRIPTION OF THE INVENTION

The following detailed description is of example embodiments of the presently claimed invention with references to the accompanying drawings. Such description is intended to be illustrative and not limiting with respect to the scope of the present invention. Such embodiments are described in sufficient detail to enable one of ordinary skill in the art to practice the subject invention, and it will be understood that other embodiments may be practiced with some variations without departing from the spirit or scope of the subject invention.

Throughout the present disclosure, absent a clear indication to the contrary from the context, it will be understood that individual circuit elements as described may be singular or plural in number. For example, the terms "circuit" and "circuitry" may include either a single component or a plurality of components, which are either active and/or passive and are connected or otherwise coupled together to provide the described function. Additionally, the term "signal" may refer to one or more currents, one or more voltages, or a data signal. Within the drawings, like or related elements will have like or related alpha, numeric or alphanumeric designators.

Figure 1:
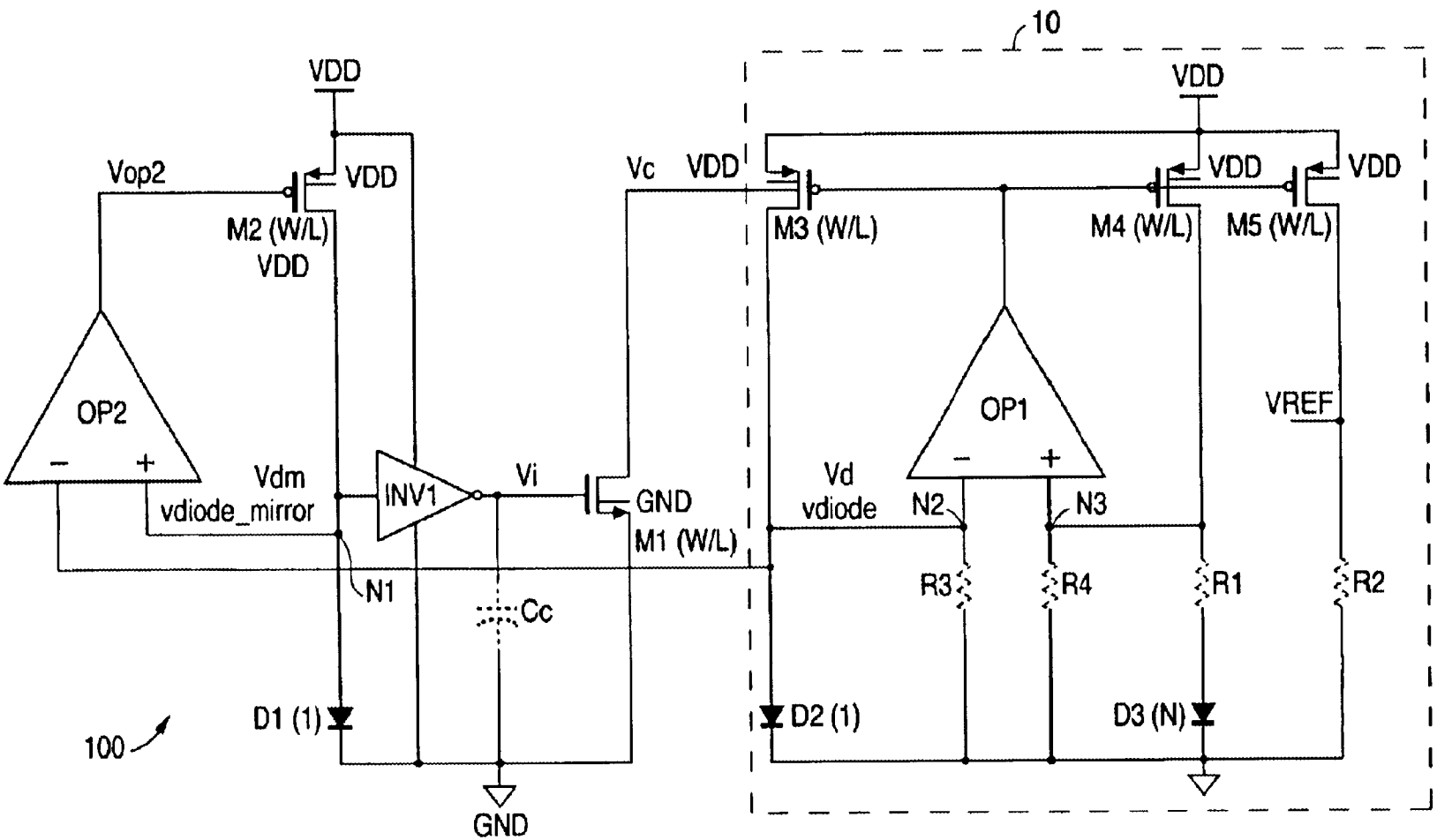
FIG. 1 is a circuit schematic diagram of a startup circuit driving a bandgap voltage reference generator circuit in accordance with one embodiment of the presently claimed invention.

Referring to FIG. 1, a startup circuit 100 in accordance with one embodiment of the present invention is used to drive a conventional bandgap voltage reference generator circuit 10 to ensure reliable startup of the bandgap reference circuit 10. As is well known, without the use of some form of startup circuit, the bandgap voltage reference generator circuit 10, following the initial application of the DC power supply voltage VDD, can settle into one of three stable operating states: an undesired state in which the input nodes N2, N3 of the operational amplifier OP1 settle at ground potential; another undesired state in which the input nodes N2, N3 of the operational amplifier OP1 settle at some unknown voltage and the diodes D2, D3 are not turned on; and the desired state in which the diodes D2, D3 are fully turned on and operating at their different respective current densities in accordance with well known bandgap voltage reference generator principles. (More general details about conventional bandgap voltage reference circuits can be found in the following U.S. patents, the disclosures of which are incorporated herein by reference: U.S. Pat. Nos. 5,686,823, 6,002,245; and 6,232,828.)

The startup circuit 100 prevents operation of the bandgap reference circuit 10 in the undesired states by ensuring that the bandgap reference circuit diodes D2, D3 are fully turned on. The startup circuit 100 achieves this by replicating, or mirroring, the voltage at the inverting terminal N2 of the operational amplifier OP1 at the non-inverting terminal N1 of the operational amplifier OP2 of the startup circuit 100. In other words, the voltage Vd across the reference diode D2 of the bandgap reference circuit 10 is replicated, or mirrored, as a corresponding voltage Vdm across a like diode D1 within the startup circuit 100.

Following circuit startup, e.g., following the initial application of the DC power supply voltage VDD, circuit nodes N2 and N1 are at circuit ground potential since their respective current sources, i.e., transistors M3 and M2 (P-MOSFETs), respectively, have not yet turned on. Accordingly, with the input to the inverter INV1 at a low logical voltage level, the output voltage Vi of the inverter INV1 is at a high logical voltage level, thereby causing output driver transistor M1 (N-MOSFET) to be turned on. Accordingly, the voltage Vc at the drain terminal of transistor M1 is pulled low, thereby applying a low voltage at the gate terminals of the current source transistors M3, M4, M5 (P-MOSFETs) of the bandgap reference circuit 10. This, in turn, turns on these transistors M3, M4, M5, thereby initiating current flow to the bandgap reference diodes D2, D3 (as well as to the load resistor R2 across which the bandgap output voltage VREF is generated).

With this current flow, the bandgap reference diodes D2, D3 turn on. As a result, the voltage Vd across the reference diode D2 increases, thereby causing the output of the operational amplifier OP2 of the startup circuit 100 to decrease in voltage. This, in turn, turns on current source transistor M2 (P-MOSFET), thereby providing current to the replica diode D1. This causes the diode D1 to turn on, thereby increasing the mirrored voltage Vdm at the input to the inverter INV1, resulting in a low inverter output voltage Vi which turns off the output driver transistor M1. Hence, proper startup of the bandgap voltage reference generator circuit 10 is achieved, following which no further effects from the startup circuit 100 are introduced to or felt by the host bandgap voltage reference generator circuit 10.

As will be evident from the foregoing discussion, the operational amplifier OP2 of the startup circuit 100 is interconnected with its associated circuitry in a negative feedback loop. In accordance with conventional operational amplifier design techniques, the impedance of the output of the operational amplifier OP2 would typically be designed as a low impedance, thereby making the output of the inverter INV1 the only high impedance node within the startup circuit 100. In the event that the stability of the overall circuit loop requires enhancement, a shunt coupling capacitor Cc can be included and designed to have any value as needed, depending upon the degree of stability enhancement required.

Figure 2:
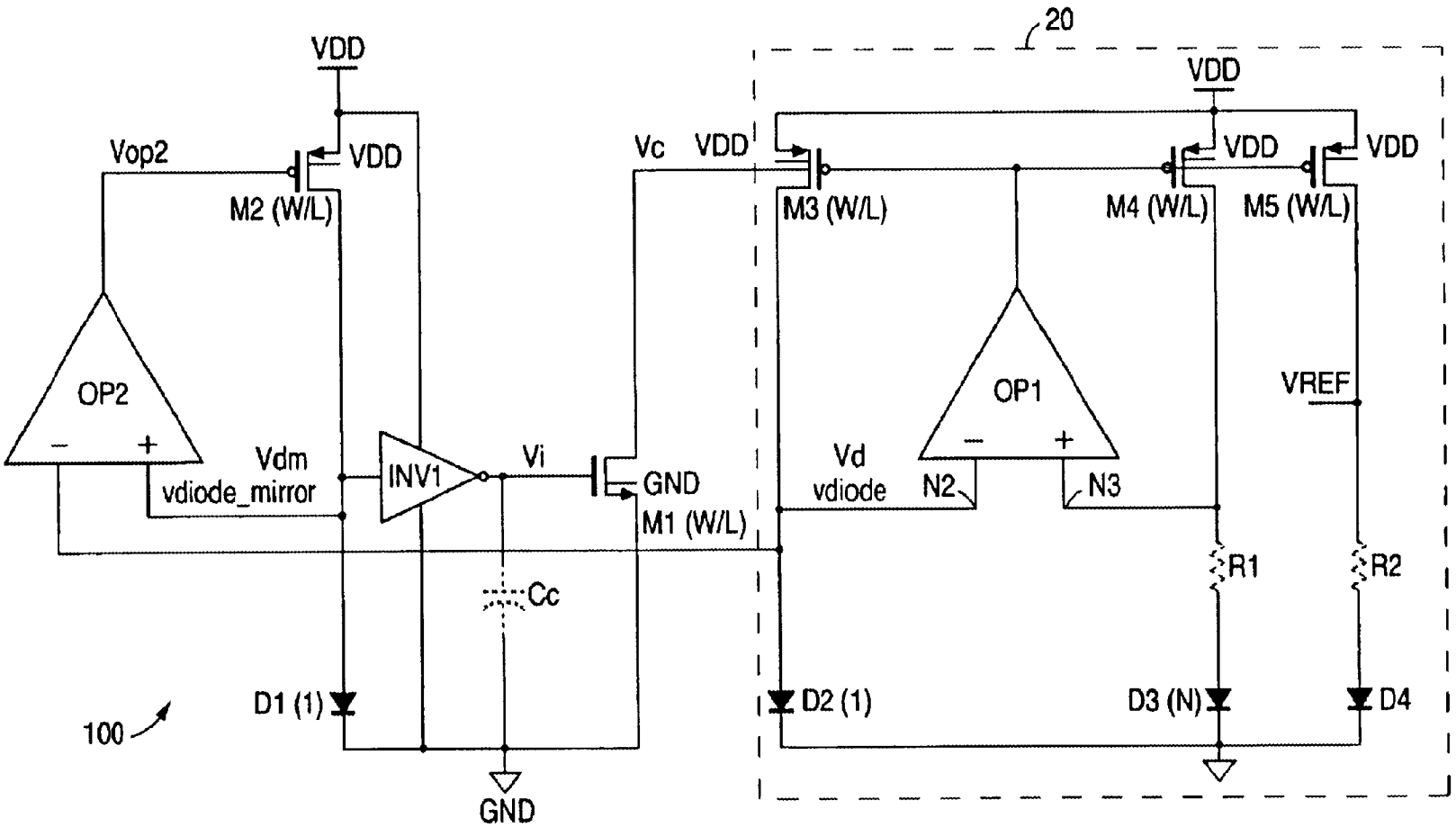
FIG. 2 is a circuit schematic diagram of the startup circuit of FIG. 1 driving another embodiment of a bandgap voltage reference generator circuit in accordance with the presently claimed invention.

The bandgap voltage reference generator circuit 10 of FIG. 1 is a conventional implementation of a bandgap voltage reference that will operate below the typical reference voltage VREF of 1.2 volts. Referring to FIG. 2, the startup circuit 100 of FIG. 1 can also be used with a conventional bandgap voltage reference generator circuit 20 designed to operate at the more typical reference voltage VREF of 1.2 volts.

Various other modifications and alternations in the structure and method of operation of this invention will be apparent to those skilled in the art without departing from the scope and the spirit of the invention. Although the invention has been described in connection with specific preferred embodiments, it should be understood that the invention as claimed should not be unduly limited to such specific embodiments. It is intended that the following claims define the scope of the present invention and that structures and methods within the scope of these claims and their equivalents be covered thereby.

What is claimed is:

1. An apparatus including a startup circuit for a bandgap voltage reference generator circuit, comprising:

a reference terminal to convey a reference voltage including first and second voltage magnitudes related to a current flow in a bandgap voltage reference generator circuit;

a control terminal to convey a current control signal for initiating said current flow; and voltage monitoring circuitry, coupled to said reference and control terminals, that provides said current control signal in response to reception of said reference voltage, wherein said current control signal includes an asserted state corresponding to said first reference voltage magnitude and a de-asserted state corresponding to said second reference voltage magnitude, and said current flow initiation occurs in response to said asserted state.

2. The apparatus of claim 1, wherein said voltage monitor circuitry includes a circuit terminal at which a replica voltage is generated responsive and proportional to said reference voltage.

3. The apparatus of claim 1, wherein said voltage monitor circuitry comprises:

voltage comparison circuitry, coupled to said reference terminal, that responds to reception of said reference voltage by comparing said reference voltage with a replica voltage corresponding to said reference voltage and in response thereto provides a voltage control signal; and voltage replication circuitry, coupled to said voltage comparison circuitry, that provides said replica voltage in response to reception of said voltage control signal.

4. The apparatus of claim 3, wherein said voltage comparison circuitry comprises a differential amplifier circuit with a first input terminal coupled to said reference terminal, a second input terminal coupled to said voltage replication circuitry and an output terminal coupled to said voltage replication circuitry.

5. The apparatus of claim 3, wherein said voltage replication circuitry comprises:

current source circuitry that conveys a current in response to said reception of said voltage control signal; and diode circuitry, coupled to said current source circuitry, that provides said replica voltage in response to reception of said current.

6. The apparatus of claim 3, wherein said voltage monitoring circuitry further comprises signal driving circuitry, coupled between said voltage replication circuitry and said control terminal, that provides said current control signal in response to reception of said replica voltage.

7. The apparatus of claim 6, wherein said signal driving circuitry comprises a current switch.

8. An apparatus including a startup circuit for a bandgap voltage reference generator circuit, comprising:

voltage replication circuitry that provides a replica voltage responsive and corresponding to reception of a reference voltage including first and second reference voltage magnitudes related to a current flow in a bandgap voltage reference generator circuit; and signal driving circuitry, coupled to said voltage replication circuitry, that provides a current control signal in response to reception of said replica voltage, wherein said current control signal includes an asserted state corresponding to said first reference voltage magnitude and a de-asserted state corresponding to said second reference voltage magnitude, and said current flow initiation occurs in response to said asserted state.

9. The apparatus of claim 8, wherein said voltage replication circuitry comprises:

voltage comparison circuitry that compares said reference voltage with a replica voltage corresponding to said reference voltage and in response thereto provides a voltage control signal; and current-voltage conversion circuitry, coupled to said voltage comparison circuitry, that generates a current in response to reception of said voltage control signal and in response thereto provides said replica voltage.

10. The apparatus of claim 9, wherein said voltage comparison circuitry comprises a differential amplifier circuit with a first input terminal to receive said reference voltage, a second input terminal coupled to said current-voltage conversion circuitry and an output terminal coupled to said current-voltage conversion circuitry.

11. The apparatus of claim 9, wherein said current-voltage conversion circuitry comprises:

current source circuitry that conveys a current in response to said reception of said voltage control signal; and diode circuitry, coupled to said current source circuitry, that provides said replica voltage in response to reception of said current.

12. The apparatus of claim 8, wherein said signal driving circuitry comprises a current switch.

13. An apparatus including a startup circuit for a bandgap voltage reference generator circuit, comprising:

reference means for conveying a reference voltage including first and second voltage magnitudes related to a current flow in a bandgap voltage reference generator circuit;

control means for conveying a current control signal for initiating said current flow; and voltage monitor means for receiving said reference voltage and in response thereto generating said current control signal, wherein said current control signal includes an asserted state corresponding to said first reference voltage magnitude and a de-asserted state corresponding to said second reference voltage magnitude, and said current flow initiation occurs in response to said asserted state.

14. The apparatus of claim 13, wherein said voltage monitor means is further for generating a replica voltage in response and proportional to said reference voltage.

15. An apparatus including a startup circuit for a bandgap voltage reference generator circuit, comprising:

voltage replicator means for receiving a reference voltage including first and second reference voltage magnitudes related to a current flow in a bandgap voltage reference generator circuit and in response thereto generating a corresponding replica voltage; and signal driver means for receiving said replica voltage and in response thereto generating a current control signal, wherein said current control signal includes an asserted state corresponding to said first reference voltage magnitude and a de-asserted state corresponding to said second reference voltage magnitude, and said current flow initiation occurs in response to said asserted state.

* * * * *

UNITED STATES PATENT AND TRADEMARK OFFICE

CERTIFICATE OF CORRECTION

PATENT NO. : 6,784,652 B1
DATED : August 31, 2004
INVENTOR(S) : Arlo Aude

It is certified that error appears in the above-identified patent and that said Letters Patent is hereby corrected as shown below:

Title page,
Item [57], ABSTRACT,
Line 5, delete "or" and replace with -- of --.

Column 2,
Line 65, after "823" please delete "," and replace with -- ; --.

Signed and Sealed this

Seventh Day of December, 2004

JON W. DUDAS
*Director of the United States Patent and Trademark Office*

UNITED STATES PATENT AND TRADEMARK OFFICE

CERTIFICATE OF CORRECTION

PATENT NO. : 6,784,652 B1
APPLICATION NO. : 10/374555
DATED : August 31, 2004
INVENTOR(S) : Aude It is certified that error appears in the above-identified patent and that said Letters Patent is hereby corrected as shown below:

Title page,
Item [*] Notice, delete "by 0 days" and insert -- by 23 days --.

Signed and Sealed this

Eleventh Day of July, 2006

JON W. DUDAS
*Director of the United States Patent and Trademark Office*